US009598257B2

(12) United States Patent
Komuro

(10) Patent No.: US 9,598,257 B2
(45) Date of Patent: Mar. 21, 2017

(54) MEDIUM STORAGE CASSETTE AND RECORDING DEVICE

(71) Applicant: SEIKO EPSON CORPORATION, Tokyo (JP)

(72) Inventor: Shintaro Komuro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/251,037

(22) Filed: Apr. 11, 2014

(65) Prior Publication Data

US 2014/0319760 A1 Oct. 30, 2014

(30) Foreign Application Priority Data

Apr. 24, 2013 (JP) ..... 2013-091042

(51) Int. Cl.

*B65H 31/20* (2006.01)
*B65H 31/22* (2006.01)
*B41J 13/10* (2006.01)
*B65H 1/26* (2006.01)

(52) U.S. Cl.

CPC ..... *B65H 31/20* (2013.01); *B41J 13/103* (2013.01); *B41J 13/106* (2013.01); *B65H 1/266* (2013.01); *B65H 31/22* (2013.01); *B65H 2405/1124* (2013.01); *B65H 2405/11164* (2013.01); *B65H 2405/111646* (2013.01); *B65H 2405/3322* (2013.01); *B65H 2801/12* (2013.01)

(58) Field of Classification Search

CPC .. B65H 1/02; B65H 2405/10; B65H 2405/11; B65H 2405/1122; B65H 2405/1124; B65H 2405/324; B65H 31/00

USPC ..... 271/213, 223

See application file for complete search history.

(56) References Cited

U.S. PATENT DOCUMENTS

| | | | | |
|---|---|---|---|---|
| 7,631,865 | B2 * | 12/2009 | Okuda | 271/213 |
| 8,172,222 | B2 * | 5/2012 | Yoda et al. | 271/162 |
| 8,690,147 | B2 * | 4/2014 | Okuchi | B65H 1/04 271/162 |
| 2006/0261535 | A1 | 11/2006 | Shiohara et al. | |
| 2007/0075477 | A1 | 4/2007 | Shiohara | |
| 2013/0164064 | A1 * | 6/2013 | Matsumoto | 399/361 |

FOREIGN PATENT DOCUMENTS

| | | |
|---|---|---|
| JP | 64-18037 | 1/1989 |
| JP | 09-2673 | 1/1997 |
| JP | 2006-273565 | 10/2006 |
| JP | 2007-091445 | 4/2007 |

* cited by examiner

*Primary Examiner* — Michael McCullough
(74) *Attorney, Agent, or Firm* — Workman Nydegger

(57) ABSTRACT

A medium storage cassette includes a medium storage portion that stores a medium; and a medium support tray that is provided in the medium storage portion such that the medium support tray can be displaced with respect to the medium storage portion in a slidable manner, the medium support tray being able to be set in a contained state that is a state in which the medium support tray is slid to an upper portion of the medium storage portion and being able to be set in an extended state that is a state in which a medium supporting surface that supports the medium becomes an inclined surface that is oriented obliquely upwards towards an end portion of the medium support tray and in which the medium supporting surface is extended outside of the medium storage portion.

8 Claims, 15 Drawing Sheets

MEDIUM STORAGE CASSETTE AND RECORDING DEVICE

BACKGROUND

1. Technical Field

The present invention relates to a medium storage cassette that is attachable/detachable with respect to a body of a recording device that carries out recording on a medium. Furthermore, the present invention relates to a recording device that is provided with the medium storage cassette.

2. Related Art

In recording devices, representative examples of which are facsimile machines and printers, a sheet cassette that is attachable/detachable with respect to an apparatus body has been widely used. Furthermore, among such recording devices, as disclosed in JP-A-2006-273565 and JP-A-2007-91445, recording devices are known that have a two-stage structure that is provided with a sheet storage portion at a lower stage and at an upper stage in an attachable/detachable sheet cassette.

Furthermore, in the sheet cassettes disclosed in JP-A-2006-273565 and JP-A-2007-91445, a second sheet feeding cassette at the upper stage is used as a discharged sheet receiving portion as well that receives the sheet on which recording has been carried out. In other words, the second sheet feeding cassette is switched, by an operation of a user, between a position in which the second sheet feeding cassette is moved back so that it will not be in the way when a sheet is sent out from the first sheet feeding cassette at the lower side and a position in which the second sheet feeding cassette is moved forward to send out a sheet from the second sheet feeding cassette. Furthermore, when in the position in which the second sheet feeding cassette is moved back, the discharged sheet receiving portion that is integrally formed together with the second sheet feeding cassette receives a relatively large sized sheet, which has been fed from the first sheet feeding cassette and on which recording has been carried out.

The above-described configuration in which the discharged sheet receiving portion is provided in the sheet cassette can advantageously reduce cost since the supporting structure that supports the discharged sheet receiving portion is not required on the body side of the recording device. However, the configuration has the following disadvantage.

That is, it is preferable that the supporting surface of the discharged sheet receiving portion that supports the sheet is an inclined surface in which the edge is oriented upwards so that the discharged sheet does not slip off. However, in the case of the above-described known technique in which the discharged sheet receiving portion is provided in the sheet cassette, if the supporting surface that supports the sheet is inclined upwards, the height dimension of the overall sheet cassette disadvantageously increases and, as a result, the height dimension of the recording device body in which the sheet cassette is installed disadvantageously increases as well.

SUMMARY

An advantage of some aspects of the invention is that a sheet cassette is provided that has a reduced height dimension despite a support tray that supports a discharged sheet being provided therein.

According to a first aspect of the invention, a medium storage cassette includes a medium storage portion that stores a medium; and a medium support tray that is provided in the medium storage portion such that the medium support tray can be displaced with respect to the medium storage portion in a slidable manner, the medium support tray being able to be set in a contained state that is a state in which the medium support tray is slid to an upper portion of the medium storage portion and being able to be set in an extended state that is a state in which a medium supporting surface that supports the medium is extended outside of the medium storage portion.

According to the first aspect, the medium support tray that is provided in the medium storage cassette can be slid to have different orientations. Accordingly, when the medium support tray is in the contained state, the dimension of the medium storage cassette in the height direction (the stacking direction of the medium) can be suppressed, and, furthermore, when the medium support tray is in the extended state, the medium support tray can be oriented appropriately.

Furthermore, since the contained state and the extended state are switched by displacing the medium support tray in a sliding manner, the state of the medium support tray can be switched while the medium storage cassette is kept installed in the apparatus body of the recording device, in other words, the state of the medium support tray can be switched without dismounting the medium storage cassette from the apparatus body.

It is preferable that when the medium support tray is in the extended state, the medium supporting surface becomes an inclined surface that is oriented obliquely upwards towards an end portion of the medium support tray.

Accordingly, when the medium support tray is in the extended state, since the medium supporting surface becomes an inclined surface that is oriented obliquely upwards towards an end portion of the medium support tray, the discharged medium can be supported in an appropriate manner.

It is preferable that the medium support tray includes a tray body that is capable of being pivoted and that forms the medium supporting surface, and arm portions that are provided at two end portions of the tray body in a pivotal axis direction of the medium support tray, the arm portions extending towards a pivotal center of the medium support tray from the tray body and being connected to the medium storage portion in a pivotal manner so as to form the pivotal center of the medium support tray.

Accordingly, the tray body of the medium support tray is pivotal with respect to the medium storage portion through the arm portions that form the pivotal center. That is to say, when the medium support tray is in the extended state, the tray body can be positioned at a position that is away from the pivotal center. Accordingly, when the medium support tray is in the extended state, the upper portion of the medium storage portion can be widely open and work efficiency in storing the medium to the medium storage portion is improved.

It is preferable that the medium support tray includes projections that form the pivotal center of the medium support tray and that are guided in the sliding direction of the medium support tray by guide rails provided in the medium storage portion, and supported portions that, when the medium support tray is in the extended state, regulate the orientation of the medium support tray by being supported by an angle restriction portion that is formed in the medium storage portion.

Accordingly, the medium support tray can be slid and, further, can be pivoted with a simple configuration.

It is preferable that the angle restriction portion are provided in a plurality, and by switching the plurality of angle restriction portions that are engaged with the supported portion, the orientation of the medium support tray can be switched.

Accordingly, since the orientation of the medium support tray can be switched by providing the plurality of angle restriction portions and by switching the angle restriction portions that are engaged with the supported portion, the orientation of the medium support tray can be appropriately set in accordance with the type and size of the medium.

According to a second aspect of the invention, a medium storage cassette includes a medium storage portion that stores a medium; and a medium support tray that can be displaced in a sliding manner with respect to the medium storage portion and that can be pivoted at any position in a sliding area, the medium support tray including a medium supporting surface that supports the medium.

Accordingly, since the medium support tray is capable of pivoting at any position in the sliding area of the medium support tray, the degree of freedom regarding combinations of the slide position and the orientation of the medium support tray is increased.

For example, even if the medium support tray is in the way when the medium support tray is slid from the contained position towards the extended position to store the medium in the medium storage portion, the medium support tray can be moved upwards and out of the way by pivoting the medium support tray; accordingly, the medium can be stored with satisfactory work efficiency.

According to a third aspect of the invention, a recording device includes a recording head that carries out recording on a medium; and the medium storage cassette according to the first aspect of the invention that can be attachable/detachable with respect to an apparatus body that includes the recording head, wherein the medium that is discharged from the apparatus body after recording has been carried out thereon is supported by the medium support tray that is in the extended state.

Accordingly, the recording device, which carries out recording on a medium, according to the third aspect can obtain advantages similar to those of the first aspect.

It is preferable that when the medium storage cassette is in a mounted state, the medium storage cassette protrudes from one of lateral sides constituting a circumference of the apparatus body, and an intermediate guide member that covers an upper portion of the medium storage cassette that protrudes from one of the lateral sides of the apparatus body is provided, the intermediate guide member guiding a discharged medium to the medium support tray when the medium support tray is in the extended state.

Accordingly, the intermediate guide member allows the medium to be discharged from the recording device body to the medium support tray in a smooth manner.

It is preferable that an opening that exposes a portion of the medium support tray that is in the contained state is formed in the intermediate guide member.

According to such an aspect, since the opening that exposes a portion of the medium support tray that is in the contained state is formed in the intermediate guide member, it is easier to hold the medium support tray and, accordingly, the medium support tray can be readily drawn out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described with reference to the drawings.

Figure 1:
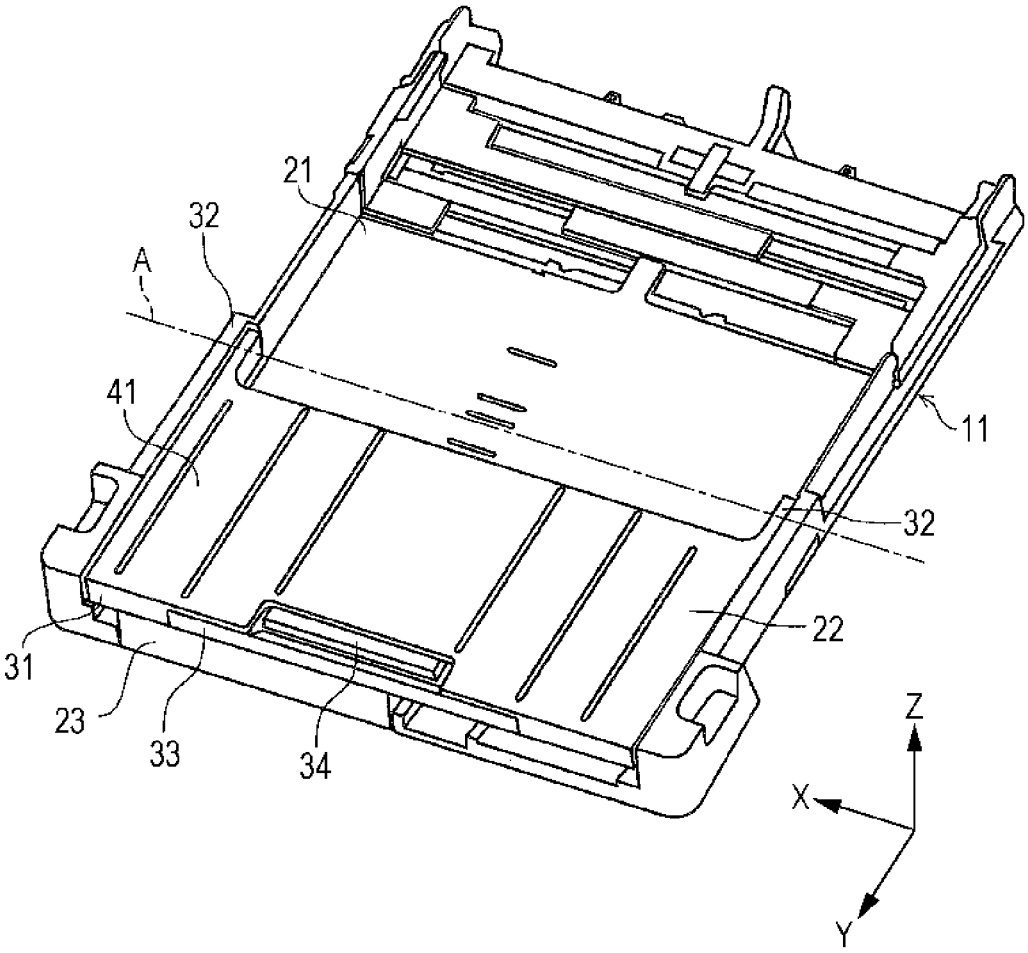
FIG. 1 is a perspective view illustrating a sheet feeding cassette according to an exemplary embodiment of the invention.
Figure 2:
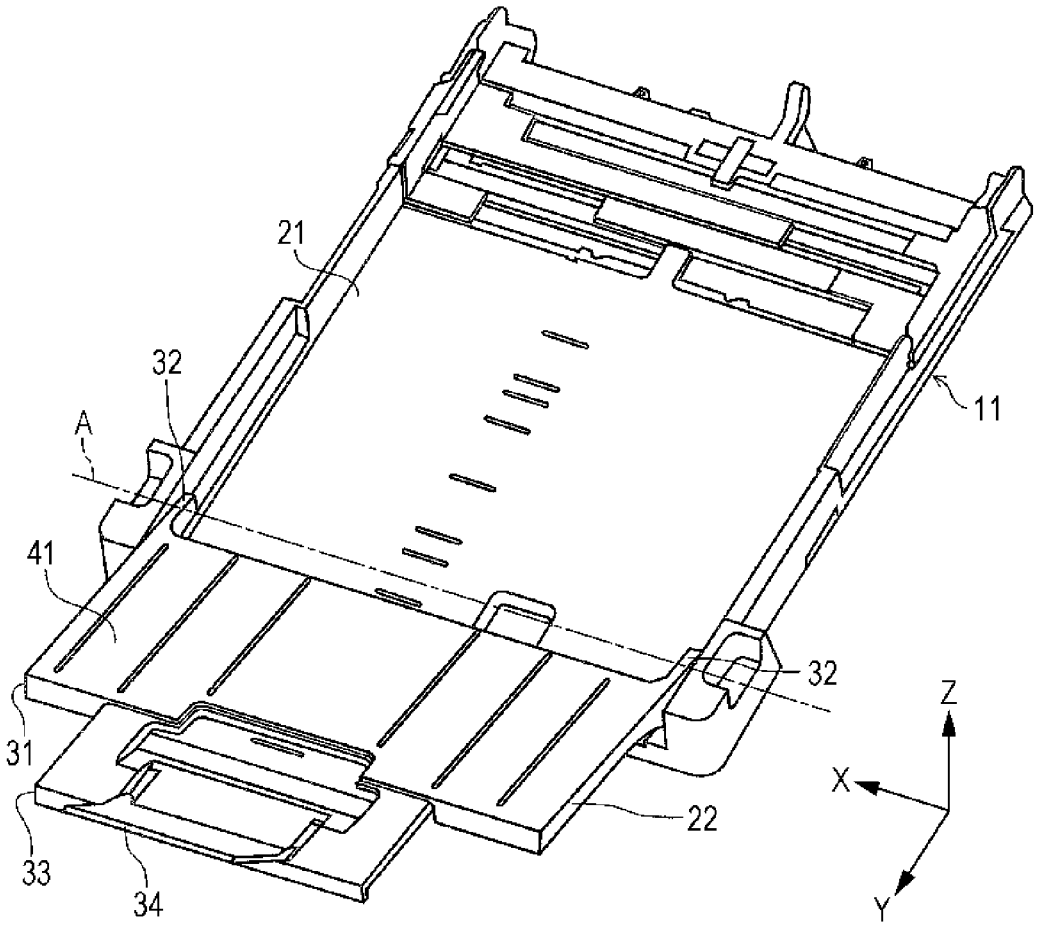
FIG. 2 is a perspective view illustrating the sheet feeding cassette according to the exemplary embodiment of the invention.

FIGS. 1 and 2 are perspective views each illustrating a sheet feeding cassette 11 serving as an exemplary embodiment of the invention. FIG. 1 is a perspective view illustrating the sheet feeding cassette 11 and a stacker 22 in a contained state that is a state in which the stacker 22 is contained in the sheet feeding cassette 11, and FIG. 2 is a perspective view illustrating the sheet feeding cassette 11 and the stacker 22 in an extended state that is a state in which the stacker 22 is extended from the sheet feeding cassette 11.

Hereinafter, a front-rear direction with respect to the sheet feeding cassette 11 is illustrated by a Y-axis, an up-down direction with a Z-axis, and a left-right direction with an X-axis. Furthermore, as regards the X-axis direction, the left side of FIG. 1 is simply referred to as the left side and the right side of FIG. 1 is simply referred to as the right side.

Furthermore, hereinafter, as regards the Y-axis direction, the near side of FIG. 1 is simply referred to as the front and the far side of FIG. 1 is simply referred to as the rear side. Additionally, hereinafter, as regards the Z-axis direction, the upper side of FIG. 1 is simply referred to as the upper side and the lower side of FIG. 1 is simply referred to as the lower side.

The sheet feeding cassette 11 is an example of a medium storage cassette that is attachable/detachable with respect to a body of a recording device that carries out recording on a medium. The sheet feeding cassette 11 stores paper that is an example of the medium.

The sheet feeding cassette 11 includes a storage portion 21, the stacker 22, and a drawer portion 23. The storage portion 21 is an example of a medium storage portion and stores sheets of paper that are stacked in the Z-axis direction. The sheet feeding cassette 11 is installed in a printer 91 (FIG. 10, described later) that is an example of the recording device. When the printer 91 carries out recording on a sheet of paper, the printer 91 draws out each of the sheets of paper stored in the storage portion 21, transports the sheet, and carries out recording on the sheet. Furthermore, the sheet feeding cassette 11 is installed in the printer 91 and supports the recorded sheet when the printer 91 carries out recording on the sheet.

Figure 3:
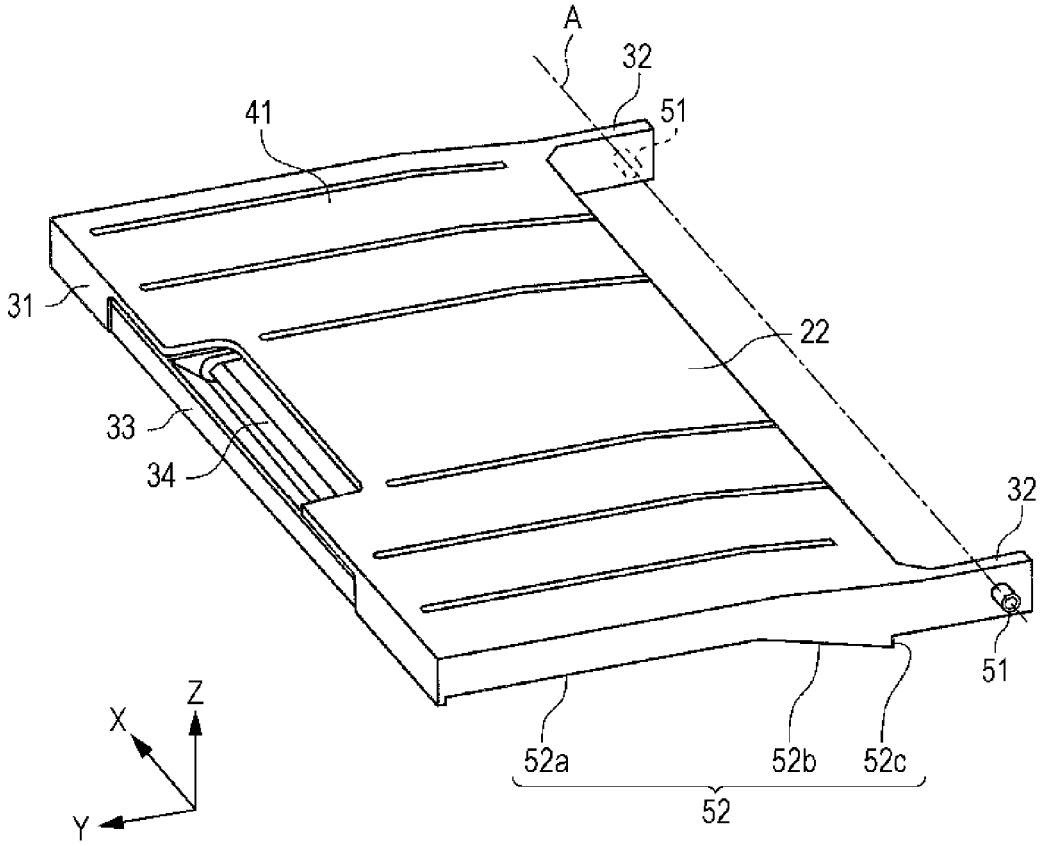
FIG. 3 is an enlarged view illustrating a stacker in an enlarged manner.

FIG. 3 is an enlarged view illustrating the stacker 22 in an enlarged manner. The stacker 22 is an example of a medium support tray. The stacker 22 supports the printed sheet when the sheet feeding cassette 11 is installed in the printer 91 and when the printer 91 carries out recording. The stacker 22 can be set in the contained state (FIG. 1) or in the extended state (FIG. 2). The stacker 22 is provided with a tray body 31, arms 32, a drawer tray 33, and an extendable tray 34. The tray body 31 is an example of a tray body. A supporting surface 41 that is an example of a medium supporting surface is formed on the upper surface of the tray body 31. The supporting surface 41 supports the sheet.

The stacker 22 is provided so that it can move in the front-rear direction with respect to the storage portion 21. In other words, the stacker 22 is provided so that it can be displaced in a sliding manner with respect to the storage portion 21. Furthermore, the stacker 22 is provided so as to be pivotal with respect to the storage portion 21 at any position in a sliding area of the stacker 22. Note that lines A in FIGS. 1 to 3 are pivotal axes each indicating a pivotal center axis of the stacker 22.

When in the contained state, the stacker 22 is positioned at the upper portion of the storage portion 21. At this time, the supporting surface 41 is substantially horizontal to the bottom surface of the storage portion 21. When the stacker 22 is in the extended state, the position of the supporting surface 41 of the stacker 22 in the Z-axis direction becomes higher the farther forward the supporting surface 41 is in the Y-axis direction. In other words, when the stacker 22 is in the extended state, the supporting surface 41, which supports the sheet, becomes an inclined surface that is oriented obliquely upwards towards the end portion of the stacker 22. Furthermore, when the stacker 22 is in the extended state, the supporting surface 41 is extended outside of the storage portion 21. Accordingly, the sheet that is discharged from above the stacker 22 and that is supported by the supporting surface 41 can be prevented from slipping off from the stacker 22 and can be supported in an appropriate manner.

By sliding the stacker 22, the stacker 22 can be made to have different orientations, in other words, the supporting surface 41 can be inclined at different angles. Accordingly, when the stacker 22 is in the contained state, the supporting surface 41 is oriented horizontally with respect to the bottom surface of the storage portion 21 and, thus, when the stacker 22 is in the contained state, the dimension of the sheet feeding cassette 11 in the height direction (the stacking direction of the medium) can be suppressed. Furthermore, when the stacker 22 is in the extended state, the stacker 22 can be oriented appropriately.

The contained state of the stacker 22 and the extended state of the stacker 22 are switched between by displacing the stacker 22 in a sliding manner; accordingly, the state of the stacker 22 can be switched while the sheet feeding cassette 11 is kept installed in the apparatus body of the recording device, in other words, the state of the stacker 22 can be switched without dismounting the sheet feeding cassette 11 from the apparatus body.

Since the stacker 22 is capable of pivoting at any position in the sliding area of the stacker 22, the degree of freedom regarding combinations of the slide position and the orientation of the stacker 22 is increased. For example, even if the stacker 22 is in the way when the stacker 22 is slid from the contained position towards the extended position to store sheets in the storage portion 21, the stacker 22 can be moved upwards and out of the way by pivoting the stacker 22; accordingly, the sheets can be stored with satisfactory work efficiency.

A user pivots the stacker 22 at the arms 32. Note that the term "users" not only refers to end users but also refers to anyone who handles the sheet feeding cassette 11 such as those who carry out assembly work and those who carry out customer service for the recording device that is provided with the sheet feeding cassette 11. The arms 32 are an example of the arm portions and are connected to the storage portion 21 in a pivotal manner such that a pivotal center of the stacker 22 is formed. The arms 32 are provided at the two end portions of the tray body 31 in the pivotal axis direction of the stacker 22. The arms 32 extend towards the pivotal center of the stacker 22 from the tray body 31.

A rotation fulcrum 51 that is a cylindrical projection is provided on both the left side of the left arm 32 and the right side of the right arm 32. Furthermore, rotation stoppers 52*a* to 52*c* each serving as a "supported portion" are provided on both the left side and the right side on the bottom surface of the tray body 31. A rotation stopper 52 includes a first portion 52*a*, which is a first linear portion having a predetermined length that extends in parallel to the Y-axis from the front side of the tray body 31, a second linear portion 52*b*, which is a second linear portion that is connected to the first portion and that extends downwards as it extends towards the back side, and a third portion 52*c*, which is a third linear portion having a predetermined length that is connected to the second linear portion and that extends in parallel to the Z-axis.

Figure 4:
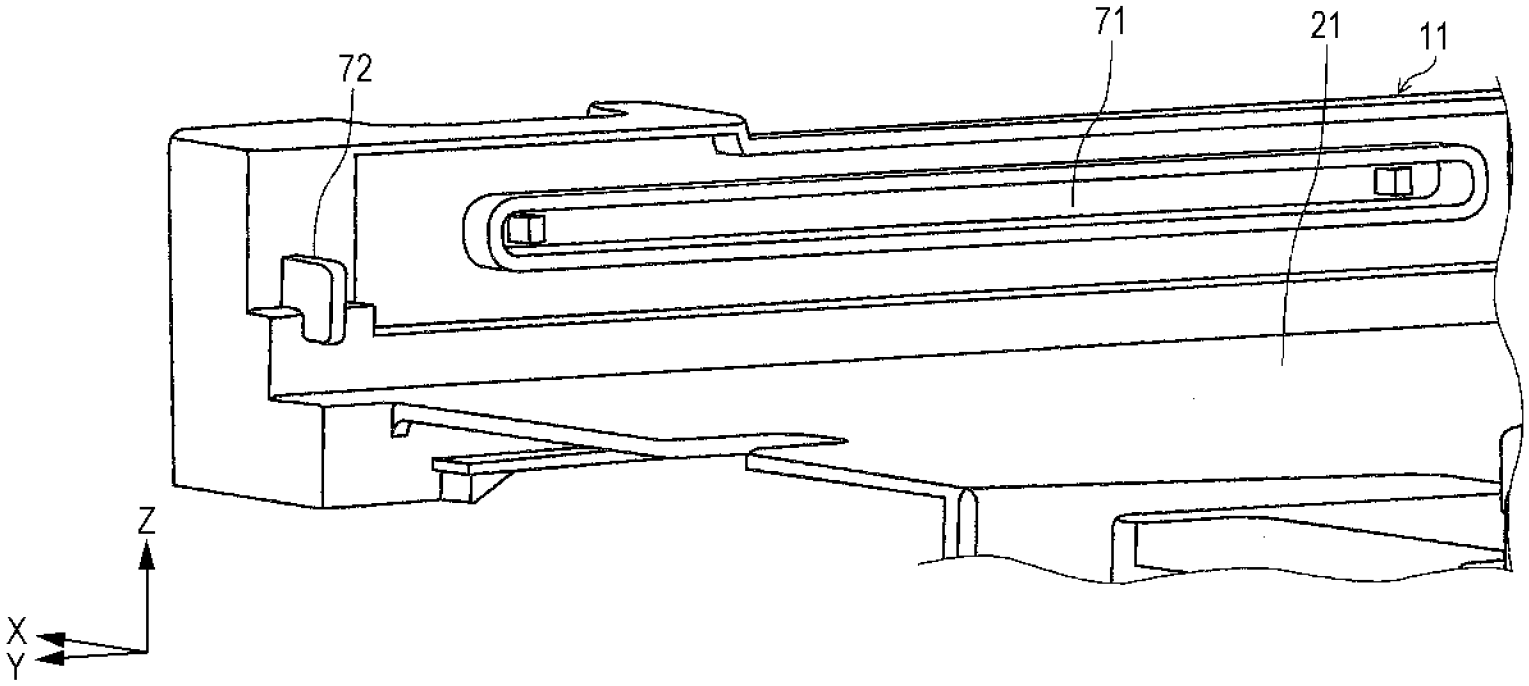
FIG. 4 is a diagram illustrating an inside of a storage portion.

FIG. 4 is a diagram illustrating the inside of the storage portion 21. Among the lateral sides inside the storage portion 21, the lateral sides that are parallel to a plane that is defined by the Z-axis and the Y-axis are each provided with a guide rail 71 and a rotation stopper 72 serving as an "angle restriction portion". Each guide rail 71 is a concavity that extends in the Y-axis direction in a linear manner and is formed as a concavity that is shaped so as to allow the corresponding rotation fulcrum 51 to be inserted therein in a rotatable manner. By inserting the rotation fulcrums 51 in the guide rails 71, the arms 32 are allowed to move in the Y-axis direction with respect to the storage portion 21 and are allowed to pivot with respect to the storage portion 21 at any position within the area in which the arms 32 are allowed to move in the Y-axis direction.

The rotation stoppers 72 are each formed as a projection that extends in the Z-axis direction and regulate the orientation of the stacker 22 by supporting the rotation stopper 52.

As described above, the stacker 22 includes a tray body 31 that forms the supporting surface 41 and the arms 32. The arms 32 are provided at the two end portions of the tray body 31 in the pivotal axis direction of the stacker 22, extend towards the pivotal center of the stacker 22 from the tray body 31, and are connected to the storage portion 21 in a pivotal manner so as to form the pivotal center of the stacker 22.

Accordingly, the stacker 22 allows the tray body 31 to pivot with respect to the storage portion 21 through the arms 32 that form the pivotal center. That is to say, when the stacker 22 is in the extended state, the tray body 31 can be positioned at a position that is away from the pivotal center. In other words, when the stacker 22 is in the extended state, the tray body 31 can be positioned at a position that is away from the storage portion 21. Accordingly, when the stacker 22 is in the extended state, the upper portion of the storage portion 21 can be widely open and work efficiency in storing the sheets to the storage portion 21 is improved.

The stacker 22 is provided with the rotation fulcrums 51 that form the pivotal center of the stacker 22 and that are guided in the sliding direction of the stacker 22 by the guide rails 71 provided in the storage portion 21 and, further, is provided with the rotation stoppers 52 that, when the stacker 22 is in the extended state, regulate the orientation of the stacker 22 by being supported by the rotation stoppers 72 that are formed in the storage portion 21. Accordingly, the stacker 22 can be slid and, further, can be pivoted with a simple configuration.

The drawer tray 33 is formed so that it can be contained in the tray body 31 and be drawn out from the tray body 31. The drawer tray 33 is formed so that the edge of the drawer tray 33 is flush with the edge of the tray body (the edge of the end portion that is on the opposite side with respect to the end portion in which the arms 32 are provided) when the drawer tray 33 is contained in the tray body 31. Furthermore, the drawer tray 33 is formed so that, when in the extended state, the upper surface of the drawer tray 33 is substantially flush with the supporting surface 41 and so that the supporting surface 41 is actually extended towards the end portion side of the tray body 31, when the drawer tray 33 is drawn out from the tray body 31.

The extendable tray 34 is provided at the edge of the drawer tray 33 in a pivotal manner and is formed so that it can be contained in the drawer tray 33 and be extended from the drawer tray 33. The extendable tray 34 moves into a concavity that is provided in the drawer tray 33 and that has a shape corresponding to the shape of the extendable tray 34 when the extendable tray 34 is contained in the drawer tray 33. Accordingly, the extendable tray 34 will not obstruct the drawer tray 33 when the drawer tray 33 is moved into or is drawn out of the tray body 31.

In the extended state, when the drawer tray 33 is drawn out of the tray body 31 and, further, when the extendable tray 34 is extended from the drawer tray 33, the extendable tray 34 forms an inclined surface that is oriented further upwards from the edge of the drawer tray 33 that forms the inclined surface that is oriented obliquely upwards. In other words, the extendable tray 34 forms an inclined surface that is oriented obliquely upwards at a steeper angle than the angle of the drawer tray 33, which forms the inclined surface oriented at a predetermined angle with respect to a horizontal plane defined by the X-axis and the Y-axis. Accordingly, the sheet, which is discharged from above the stacker 22 and is supported by the supporting surface 41, can be prevented from slipping off from the edge of the tray body 31, and, thus, the sheet can be supported in an appropriate manner.

The drawer portion 23 constitutes a wall surface on the front side (on the sheet discharging side, that is, on the +Y side) of the storage portion 21 and is provided in the front portion of the sheet feeding cassette 11. The drawer portion 23 is formed so that it can be drawn out towards the front side from the storage portion 21. The drawer portion 23 is drawn out towards the front side from the storage portion 21 when a sheet that has a length that is longer than the length of the sheet feeding cassette 11 in the Y-axis direction is stored in the sheet feeding cassette 11.

Note that the length of the drawer portion 23 in the sheet width direction (the length in the X direction) is shorter than the length of the storage portion 21 in the sheet width direction. Accordingly, a gap 25 (FIGS. 10 and 11) into which fingers can be inserted is formed next to the drawer portion 23. Accordingly, regardless of the state of the stacker 22, fingers can be hooked onto the drawer portion 23; accordingly, a sliding operation of the drawer portion 23 can be facilitated. Furthermore, whether there are any sheets left or the remaining amount of sheet in the sheet feeding cassette can be readily checked through the gap 25 formed next to the drawer portion 23 even when the sheet feeding cassette 11 is installed in the printer body.

Furthermore, because the drawer portion 23 is arranged at a position that is offset from the center portion of the storage portion 21 in the sheet width direction (the left side in the figures of the present exemplary embodiment), a large gap 25, which is formed next to the drawer portion 23, can be obtained; accordingly, the operation of the drawer portion 23 can be further facilitated.

Note that the role of the drawer portion 23 is to increase the size of the sheets that can be stored in the storage portion 21; accordingly, the drawer portion 23 does not need to constitute the inner wall of the storage portion 21 and the drawer portion 23 may be configured in any way that serves as an edge guide that supports the rear end of the sheet, for example.

As described above, the sheet feeding cassette 11 includes the storage portion 21, in which sheets are stored, and the stacker 22 that is provided so that it can be displaced in a sliding manner with respect to the storage portion 21. The stacker 22 can be slid to the contained state, which is a state in which the stacker 22 is positioned at the upper portion of the storage portion 21, and to the extended state, which is a state in which the supporting surface 41 that supports the sheet becomes an inclined surface that is oriented towards the end portion and in which the supporting surface 41 is extended to the outside of the storage portion 21. By sliding the stacker 22, the stacker 22 that is provided in the sheet feeding cassette 11 can be made to have different orientations.

Furthermore, the sheet feeding cassette 11 includes the storage portion 21, in which sheets are stored, and the stacker 22 that is provided with the supporting surface 41 that supports the sheets. The stacker 22 is provided so that it can be displaced in a sliding manner with respect to the storage portion 21 and is provided so as to be pivotal at any position in the sliding area. Since the stacker 22 is capable of pivoting at any position in the sliding area of the stacker 22, the degree of freedom regarding combinations of the slide position and the orientation of the stacker 22 is increased.

Figure 5:
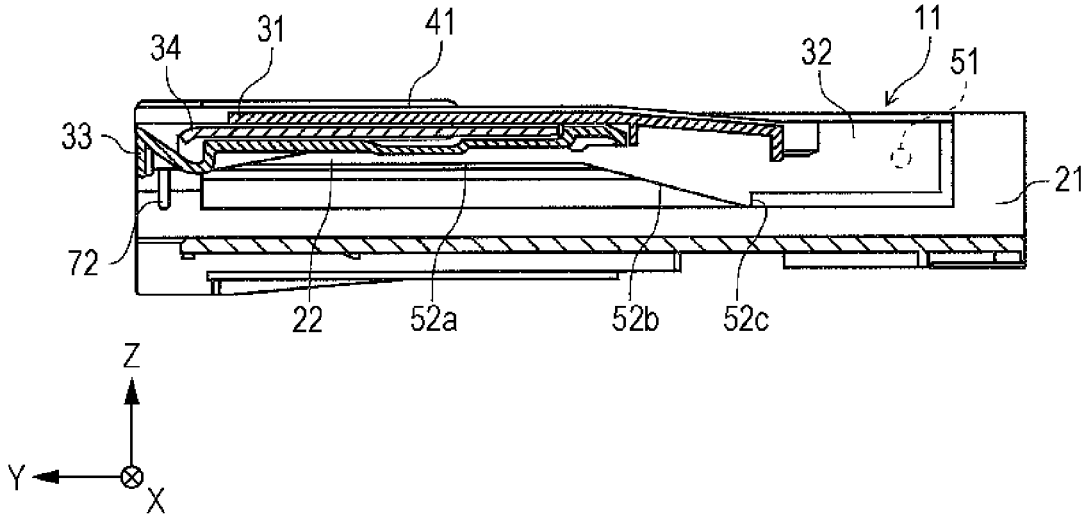
FIG. 5 is a diagram for illustrating a transition of the sheet feeding cassette according to the exemplary embodiment of the invention from a contained state to an extended state.

Referring now to FIGS. 5 to 9, transition of the sheet feeding cassette 11 from the contained state to the extended state will be described. FIG. 5 is a cross-sectional view of the sheet feeding cassette 11 in the contained state taken along a plane that is parallel to a flat plane defined by the Z-axis and the Y-axis. The stacker 22 is positioned at the upper portion of the storage portion 21 when it is in the contained state. More specifically, the stacker 22 is arranged above the storage portion 21 such that the front side of the tray body 31 of the stacker 22 is flush with the front side of the sheet feeding cassette 11.

In the contained state, the extendable tray 34, which is provided at the edge of the drawer tray 33 in a pivotal manner, is contained in the drawer tray 33. Furthermore, when in the contained state, the drawer tray 33 containing the extendable tray 34 is contained in the tray body 31.

Figure 6:
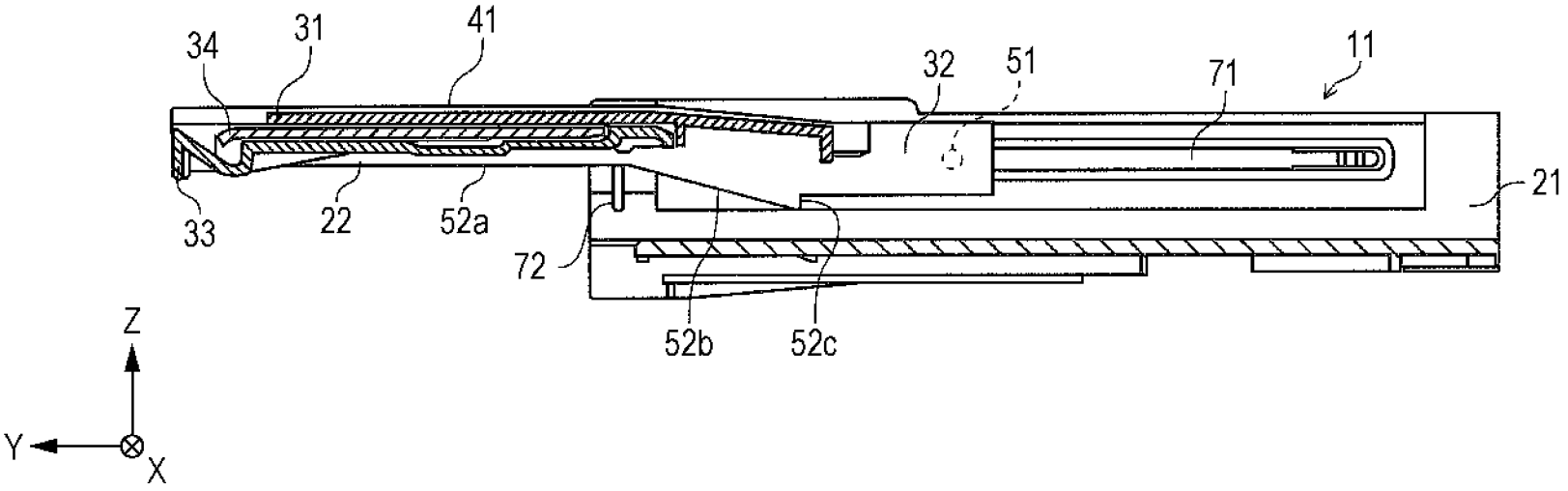
FIG. 6 is a diagram for illustrating the transition of the sheet feeding cassette according to the exemplary embodiment of the invention from the contained state to the extended state.

When a user draws out the stacker 22 from the sheet feeding cassette 11 to the front, as illustrated in FIG. 6, the rotation fulcrums 51 move forward along the guide rails 71 while the first portion 52*a* (the first linear portion having the predetermined length that extends in parallel to the Y-axis from the front side of the tray body 31) of each rotation stopper 52 is supported by the corresponding rotation stopper 72; accordingly, the stacker 22 is moved to the front in a substantially parallel manner with respect to the storage portion 21.

Figure 7:
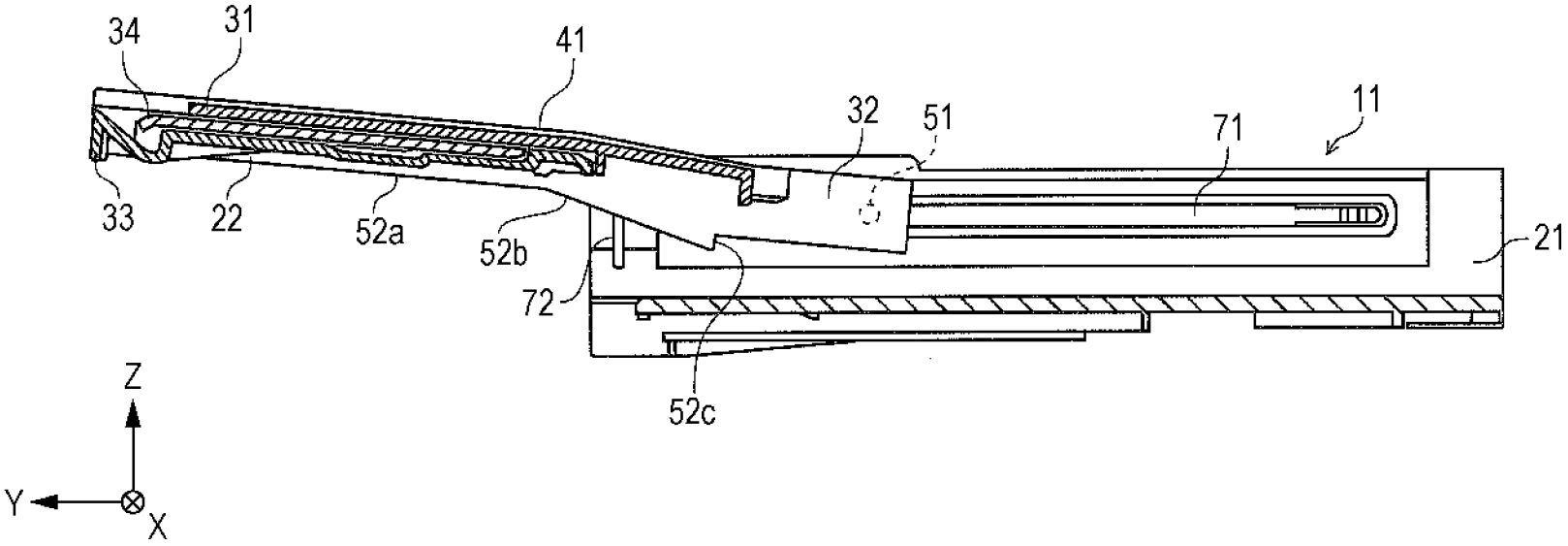
FIG. 7 is a diagram for illustrating the transition of the sheet feeding cassette according to the exemplary embodiment of the invention from the contained state to the extended state.

When the user draws the stacker 22 further forward, as illustrated in FIG. 7, each rotation stopper 72 comes into contact with the second portion 52*b* (the second linear portion that is connected to the first portion 52*a* and that extends downwards as it extends towards the back side) of the corresponding rotation stopper 52. Since the second portion 52*b* of each rotation stopper 52 extends downwards as it extends towards the back side and, furthermore, the rotation fulcrums 51 move towards the front along the guide rails 71 such that the positions of the rotation fulcrums 51 in the up-down direction are maintained, the stacker 22 becomes inclined so that the front side becomes higher and the supporting surface 41, which supports the sheet, becomes an inclined surface that is oriented obliquely upwards towards the end portion of the stacker 22.

Figure 8:
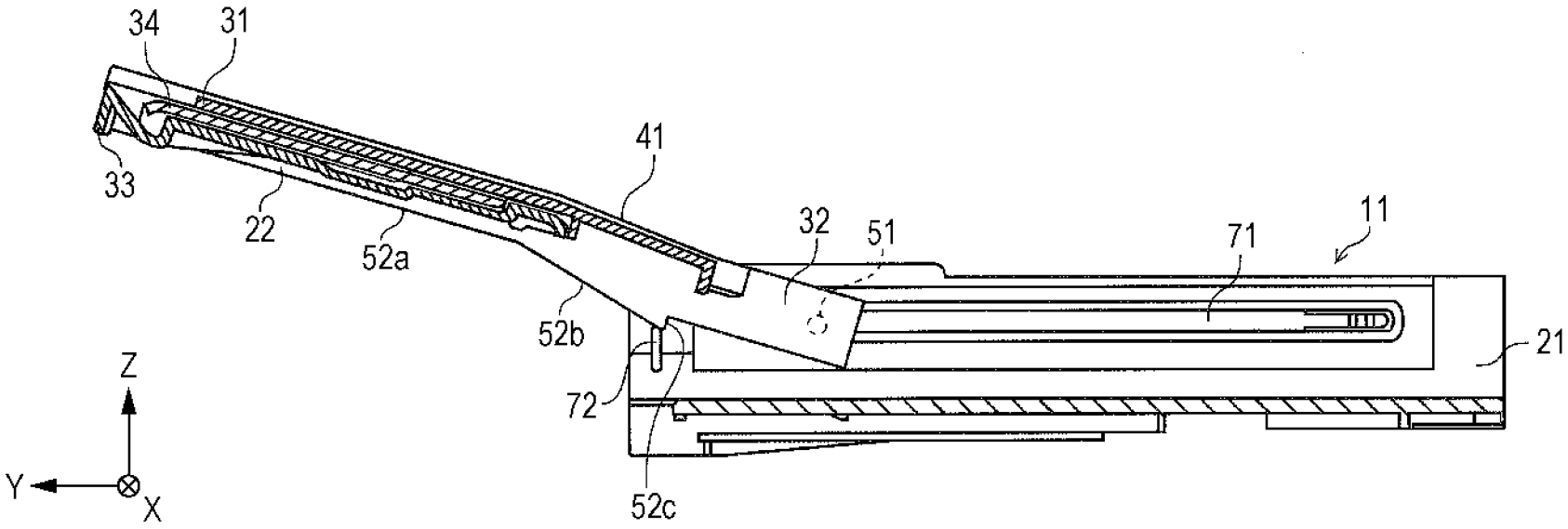
FIG. 8 is a diagram for illustrating the transition of the sheet feeding cassette according to the exemplary embodiment of the invention from the contained state to the extended state.

When the user draws the stacker 22 further forward from the position illustrated in FIG. 7, as illustrated in FIG. 8, the rear side position of the second portion 52*b* of each rotation stopper 52 is supported by the corresponding rotation stopper 72 and, furthermore, the rotation fulcrums 51 move towards the front along the guide rails 71 such that the positions of the rotation fulcrums 51 in the up-down direction are maintained; accordingly, the inclination of the stacker 22 becomes further steeper.

Figure 9:
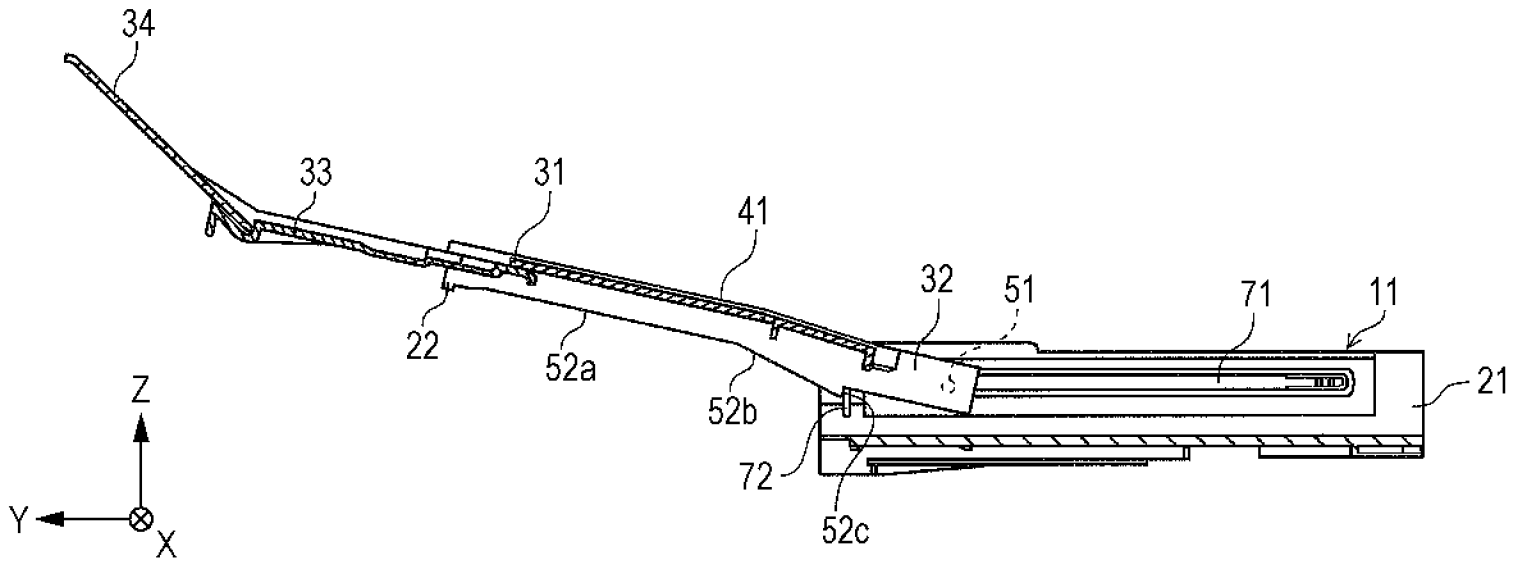
FIG. 9 is a diagram for illustrating the transition of the sheet feeding cassette according to the exemplary embodiment of the invention from the contained state to the extended state.

When the user draws the stacker 22 further forward from the position illustrated in FIG. 8, as illustrated in FIG. 9, each rotation stopper 72 fits into the third portion 52*c* (the third linear portion having a predetermined length that is connected to the second linear portion 52*b* and that extends in parallel to the Z-axis) of the corresponding rotation stopper 52, each rotation stopper 72 supports the third portion 52*c* of the corresponding rotation stopper 52, the positions of the rotation fulcrums 51 in the up-down direction are maintained by the guide rails 71, and, further, the rotation fulcrums 51 are abutted against the front side of the guide rails 71.

Accordingly, the stacker 22 becomes stable when the stacker 22 is inclined such that the front side is higher and when the supporting surface 41 becomes an inclined surface that is oriented obliquely upwards towards the end portion of the stacker 22. Now, the user draws out the drawer tray 33 from the tray body 31 and, further, pivots the extendable tray 34 so that the extendable tray 34 is extended from the drawer tray 33.

Accordingly, as illustrated in FIG. 9, the sheet feeding cassette 11 is extended to the extended state.

A printer in which the sheet feeding cassette 11 is installed will be described next.

Figure 10:
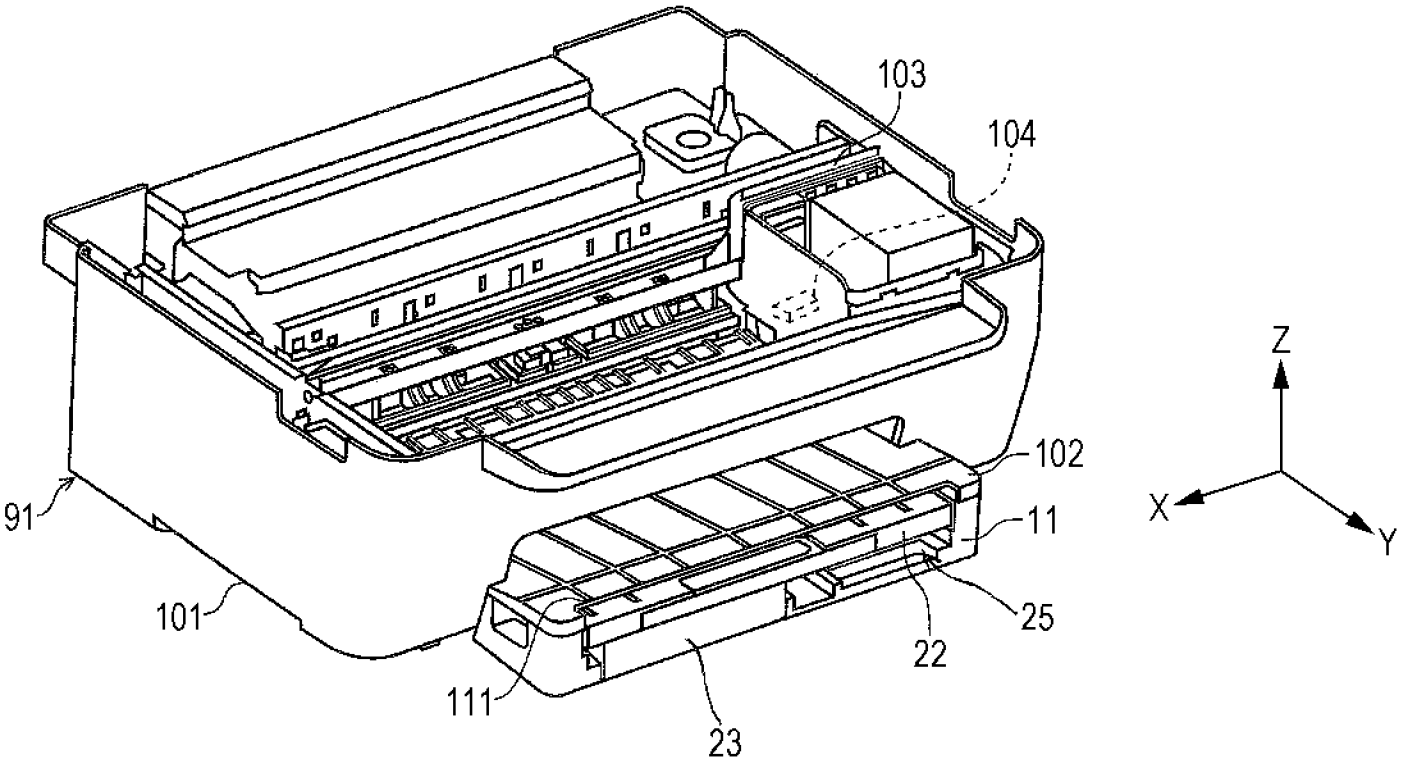
FIG. 10 is a perspective view illustrating a section and appearance of an upper portion of a printer according to the exemplary embodiment of the invention.
Figure 11:
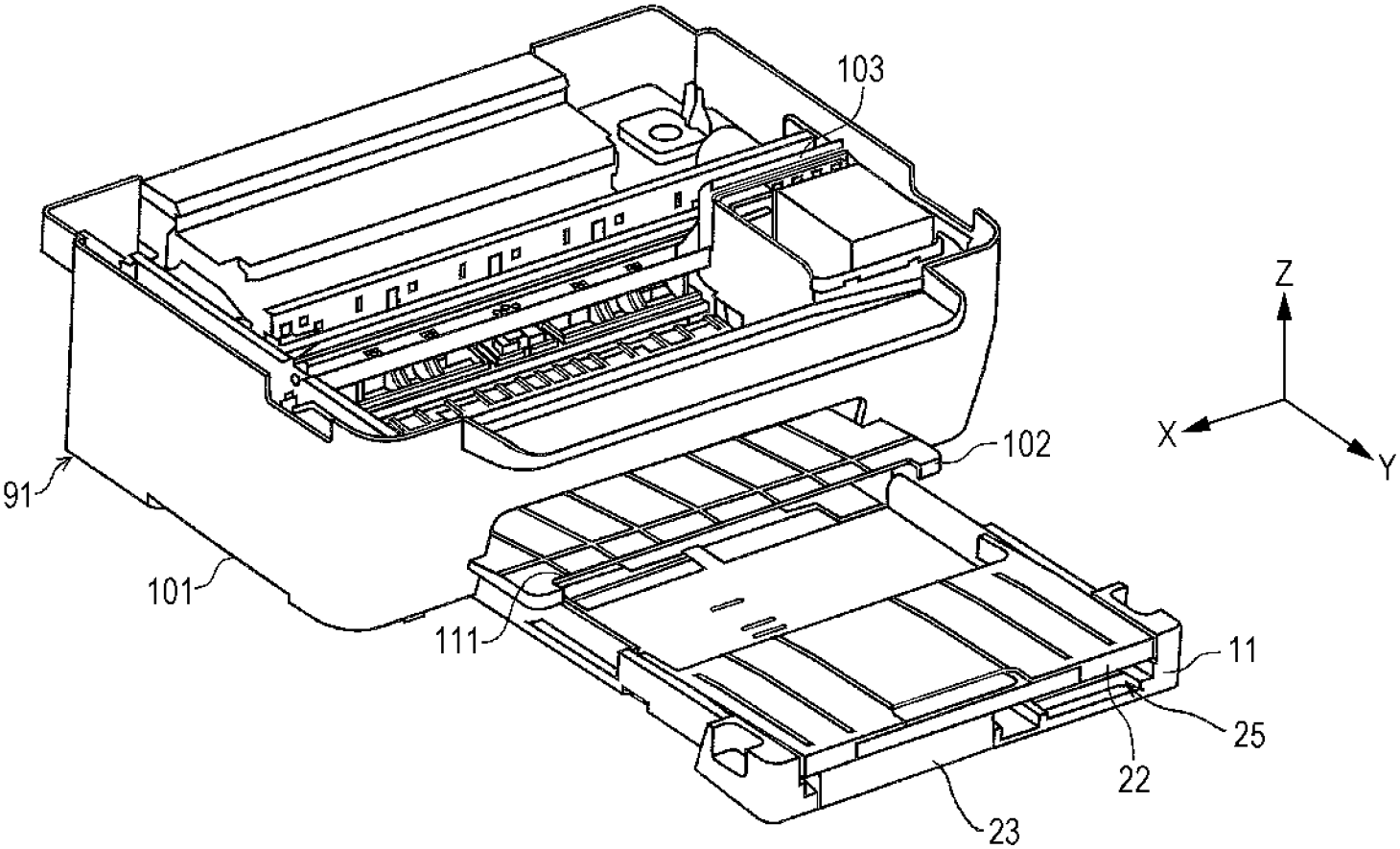
FIG. 11 is a perspective view illustrating the section and the appearance of the upper portion of the printer according to the exemplary embodiment of the invention.
Figure 12:
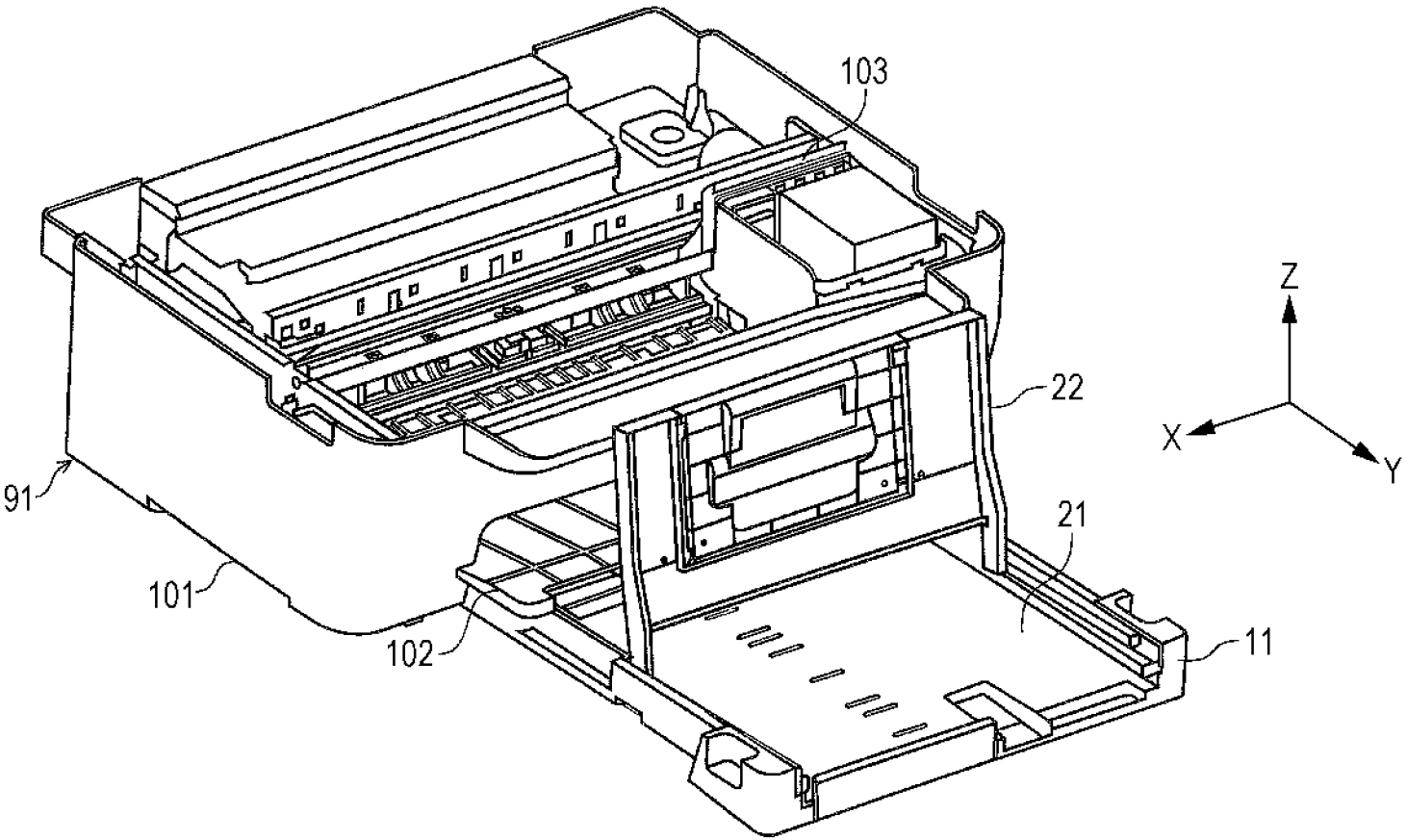
FIG. 12 is a perspective view illustrating a section and the appearance of the upper portion of the printer according to the exemplary embodiment of the invention.
Figure 13:
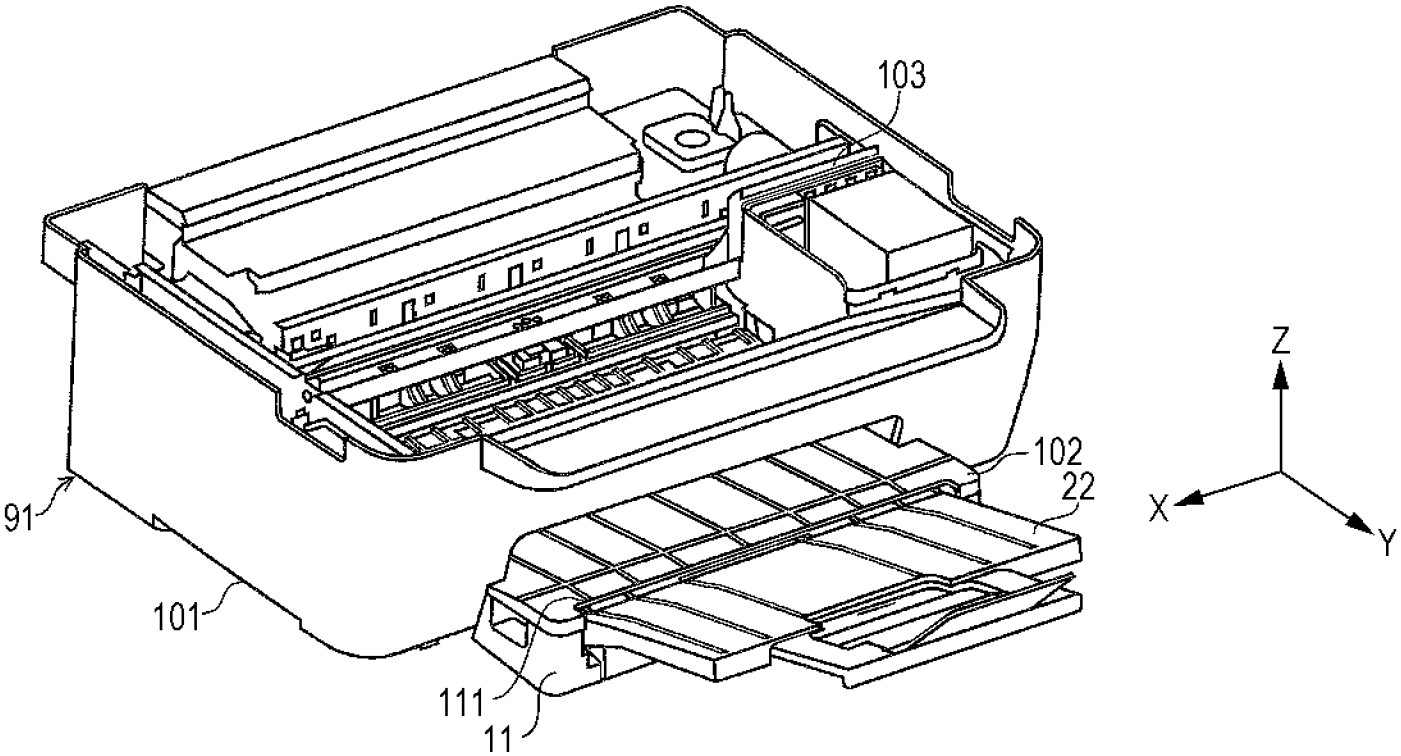
FIG. 13 is a perspective view illustrating the section and the appearance of the upper portion of the printer according to the exemplary embodiment of the invention.

FIGS. 10 to 13 are perspective views each illustrating a section and appearance of an upper portion of the printer 91 including the sheet feeding cassette 11. FIG. 10 is a perspective view illustrating a section and appearance of an upper portion of the printer 91 on which the sheet feeding cassette 11 in the contained state is mounted and FIG. 11 is a perspective view illustrating a section and appearance of an upper portion of the printer 91 from which the sheet feeding cassette 11 in the contained state is drawn out. FIG. 12 is a perspective view illustrating a section and appearance of an upper portion of the printer 91 in which the stacker 22 of the sheet feeding cassette 11 that has been drawn out is pivoted and is in an open state and FIG. 13 is a perspective view illustrating a section and appearance of an upper portion of the printer 91 on which the sheet feeding cassette 11 in the extended state is mounted.

The printer 91 is an example of the recording device and records characters and images on the sheet that is stored in the sheet feeding cassette 11. The printer 91 includes the sheet feeding cassette 11, a body 101, a cover 102, a carriage 103, and a recording head 104. In addition to the cover 102, the carriage 103, and the recording head 104, the body 101 of the printer 91 is provided with a transport unit (not shown) that transports a sheet, a control panel (not shown) that is operated by the user, and a controller (not shown) that controls the entire printer 91.

The body 101 is an example of the apparatus body. The cover 102 is an example of a guide member and is provided in an opening, in which the sheet feeding cassette 11 is mounted and that is an opening of the body 101. The cover 102 covers the upper portion of the sheet feeding cassette 11 that protrudes from the lateral side of the body 101 when the sheet feeding cassette 11 is mounted in the body 101. A cut-out (an opening) 111 that exposes a portion of the stacker 22 that is in the contained state is formed in the cover 102. In other words, when seen from above, a rectangular cut-out 111, that is, an opening, is formed at the front end portion of the cover 102. Accordingly, when drawing out the stacker 22, it is easier to hold the stacker 22 and, accordingly, the stacker 22 is readily drawn out.

The carriage 103 includes the recording head 104 that records characters and images on a sheet with ink or the like. When recording is carried out, the carriage 103 is moved in the X-axis direction with a power of a motor (not shown), for example. The recording head 104 is an example of a recording device and carries out recoding on a sheet. More specifically, the recording head 104 is provided on the bottom surface side of the carriage 103, in other words, the recording head 104 is provided on the side of the sheet that is transported by the transport unit, and records characters and images on a sheet with ink or the like.

For example, when the printer 91 is not used, as illustrated in FIG. 10, the sheet feeding cassette 11 is in the contained state and the sheet feeding cassette 11 in the contained state is installed in the printer 91. When using the printer 91 or when storing the sheets in the sheet feeding cassette 11, first, as illustrated in FIG. 11, the sheet feeding cassette 11 in the contained state is drawn out from the printer 91.

Furthermore, when storing the sheets in the sheet feeding cassette 11, as illustrated in FIG. 12, the stacker 22 of the sheet feeding cassette 11 that has been drawn out is pivoted and opened so that the edge faces up. Accordingly, the upper portion of the storage portion 21 is widely open and, thus, the sheets can be easily stored in the storage portion 21 from above and work efficiency in storing the sheets to the storage portion 21 is improved.

When using the printer 91, the sheet feeding cassette 11 is extended to the extended state. In other words, when the user draws out the stacker 22 to the front and pivots the stacker 22 such that the edge of the stacker 22 faces obliquely upward, the stacker 22 is inclined such that the front side is higher and the supporting surface 41 that supports the sheet becomes an inclined surface that is oriented obliquely upwards towards the end portion. At this time, the stacker 22 is extended outside of the storage portion 21. Furthermore, the user draws out the drawer tray 33 from the tray body 31 and, further, pivots the extendable tray 34 so that the extendable tray 34 is extended from the drawer tray 33.

In the mounted state, the sheet feeding cassette 11 protrudes from one of the lateral sides constituting the circumference of the body 101. The cover 102 covers the upper portion of the sheet feeding cassette 11 that protrudes from one of the lateral sides. The sheet, on which recording has been carried out, that is discharged from the body 101 is supported by the stacker 22 that is in the extended state. When the stacker 22 is in the extended state, the cover 102 guides the discharged sheet to the stacker 22. The cover 102 allows the sheet to be discharged to the stacker 22 from the body 101 in a smooth manner.

Figure 14:
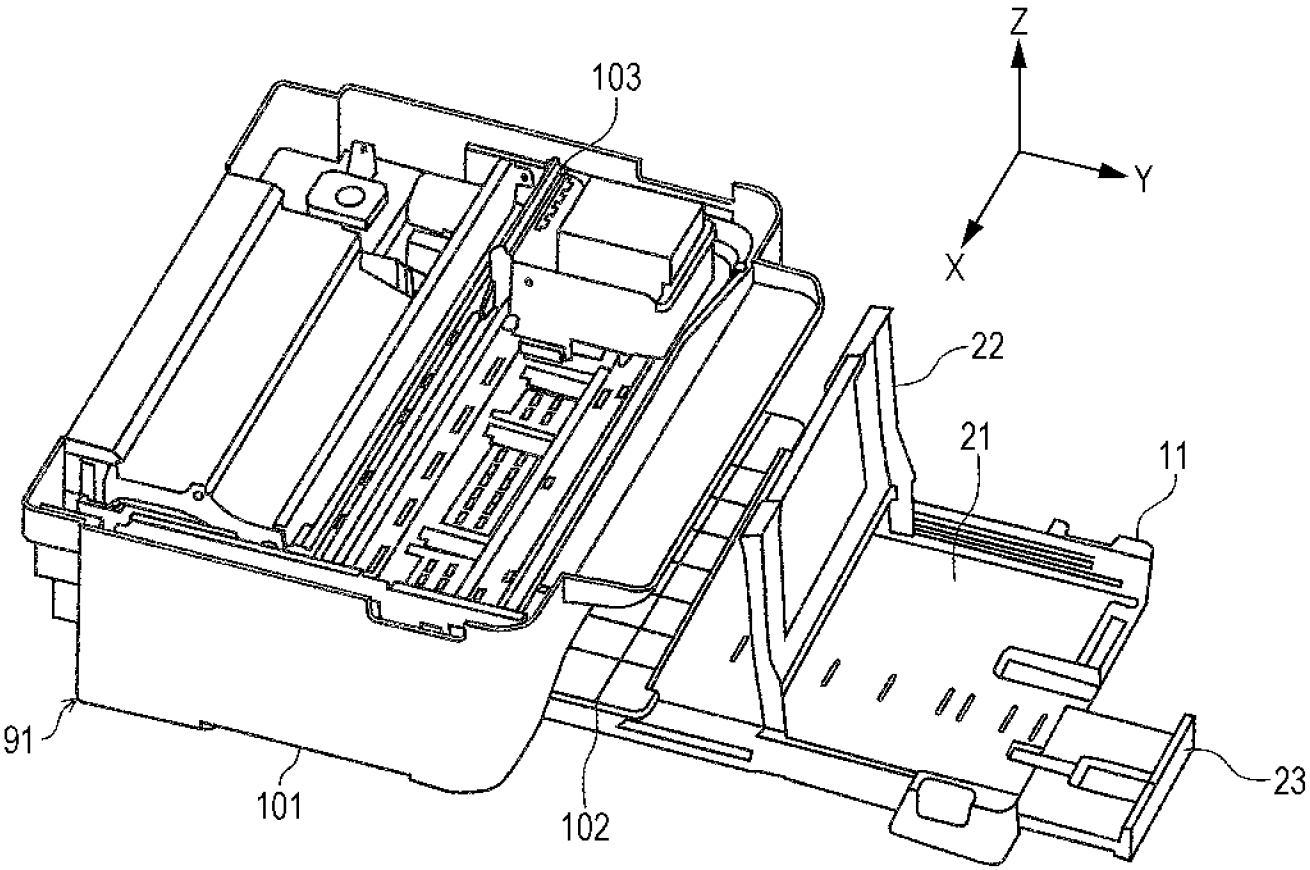
FIG. 14 is a perspective view illustrating the section and the appearance of the upper portion of the printer according to the exemplary embodiment of the invention.

FIG. 14 is a perspective view illustrating a section and appearance of an upper side of the printer 91 in which the stacker 22 of the sheet feeding cassette 11 that has been drawn out is pivoted and opened and in which the drawer portion 23 is drawn out to the front from the storage portion 21. When the drawer portion 23 is drawn out to the front from the storage portion 21, the upper portion of the storage portion 21 becomes open wide and, further, the storage portion 21 becomes widely opened in the Y-axis direction; accordingly, the sheet can be readily stored in the storage portion 21. Furthermore, a sheet that is longer than the length of the sheet feeding cassette 11 in the Y-axis direction can be stored in the sheet feeding cassette 11.

Figure 15:
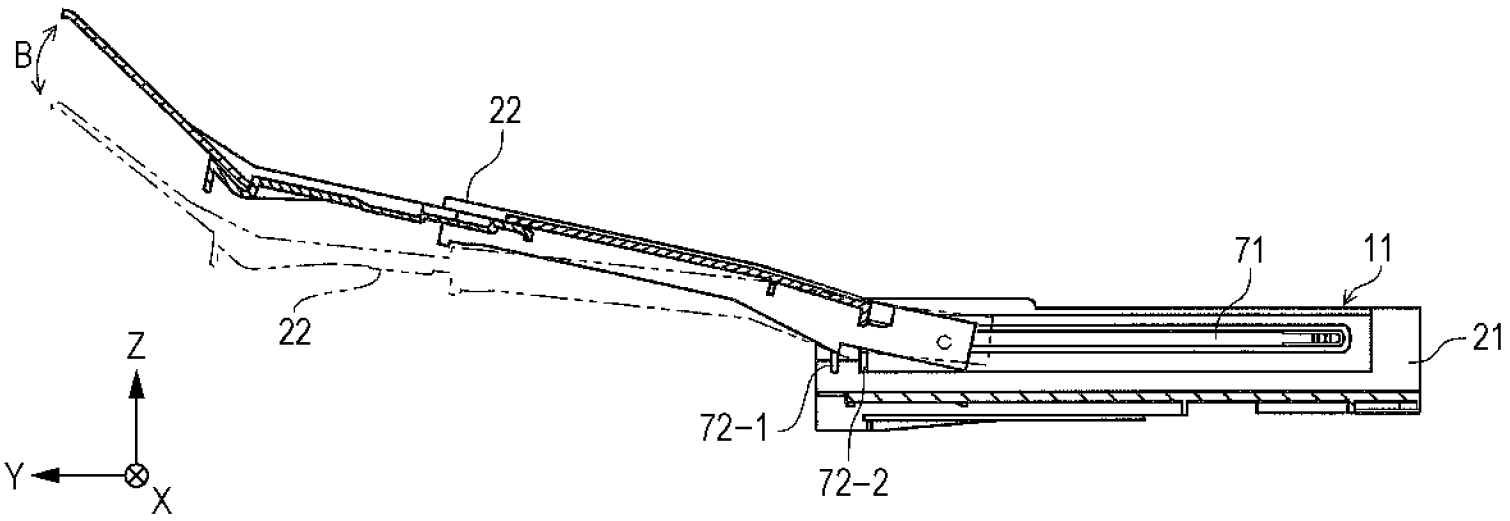
FIG. 15 is a side view illustrating the extended state of the sheet feeding cassette.

Note that in the above description, a case in which a pair of single rotation stoppers 72 are provided has been described as an example; however, not limited to the above case, as illustrated in FIG. 15, rotation stoppers 72-1 and 72-2 may be provided with a predetermined distance between each other in the Y-axis direction, for example. Between a case in which the rotation stoppers 52, which are each provided on the left side and the right side of the bottom surface of the tray body 31, are supported by the rotation stoppers 72-1 and a case in which the rotation stoppers 52 are supported by the rotation stoppers 72-2, the position of the edge of the extended stacker 22 is changed in the up-down direction by a distance B illustrated in FIG. 15, for example.

In other words, the angle of inclination of the supporting surface 41 that supports the sheet can be changed. As described above, the orientation of the stacker 22 can be switched by providing a plurality of rotation stoppers 72 and switching the rotation stopper 72 that is engaged with the rotation stopper 52. Since the orientation of the stacker 22 can be switched by providing the plurality of rotation stoppers 72 and switching the rotation stopper 72 that is engaged with the rotation stopper 52, the orientation of the stacker 22 can be appropriately set in accordance with the type and size of the sheet.

Furthermore, while the printer 91 is described as an example of the recording device, the recording device may be other devices such as a printing apparatus, a copying machine, or a facsimile apparatus.

As described above, the sheet feeding cassette 11 includes the storage portion 21, in which the sheets are stored, and the stacker 22 that is provided so that it can be displaced in a sliding manner with respect to the storage portion 21. The stacker 22 can be set in the contained state that is a state in which the stacker 22 is positioned at the upper portion of the storage portion 21 by being slid thereto and can be set in the extended state that is a state in which at least a portion of the supporting surface 41 that supports the sheet is extended outside of the storage portion 21. By sliding the stacker 22, the stacker 22 that is provided in the sheet feeding cassette 11 can have different orientations. Accordingly, in the contained state, the dimension of the sheet feeding cassette 11 in the height direction (the stacking direction of the medium) can be suppressed. Furthermore, in the extended state, the stacker 22 can be oriented appropriately. The contained state and the extended state are switched by displacing the stacker 22 in a sliding manner; accordingly, the state of the stacker 22 can be switched while the sheet feeding cassette 11 is kept installed in the apparatus body of the recording device, in other words, the state of the stacker 22 can be switched without dismounting the sheet feeding cassette 11 from the apparatus body.

Furthermore, when the stacker 22 is in the extended state, the supporting surface 41 becomes an inclined surface that is oriented obliquely upwards towards the end portion of the stacker 22. Accordingly, the sheet that is discharged can be prevented from slipping off from the supporting surface 41 and the sheet can be supported in an appropriate manner.

The stacker 22 is provided so as to be pivotal at any position in the sliding area of the stacker 22. Since the stacker 22 is capable of pivoting at any position in the sliding area of the stacker 22, the degree of freedom regarding combinations of the slide position and the orientation of the stacker 22 is increased. For example, even if the stacker 22 is in the way when the stacker 22 is slid from the contained position towards the extended position to store some sheets in the storage portion 21, the stacker 22 can be moved upwards and out of the way by pivoting the stacker 22; accordingly, the sheets can be stored with satisfactory work efficiency.

As described above, the stacker 22 includes a tray body 31 that forms the supporting surface 41 and the arms 32. The arms 32 are provided at the two end portions of the tray body 31 in the pivotal axis direction of the stacker 22, extend towards the pivotal center of the stacker 22 from the tray body 31, and are connected to the storage portion 21 in a pivotal manner so as to form the pivotal center of the stacker 22. The stacker 22 allows the tray body 31 to pivot with respect to the storage portion 21 through the arms 32 that form the pivotal center. That is to say, when the stacker 22 is in the extended state, the tray body 31 can be positioned at a position that is away from the pivotal center. Accordingly, when the stacker 22 is in the extended state, the upper portion of the storage portion 21 can be widely open and work efficiency in storing the sheets to the storage portion 21 is improved.

The stacker 22 is provided with the rotation fulcrums 51 that form the pivotal center of the stacker 22 and that are guided in the sliding direction of the stacker 22 by the guide rails 71 provided in the storage portion 21 and, further is provided with the rotation stoppers 52 that, when the stacker 22 is in the extended state, regulate the orientation of the stacker 22 by being supported by the rotation stoppers 72 that are formed in the storage portion 21. The stacker 22 can be slid and, further, can be pivoted with a simple configuration.

The orientation of the stacker 22 can be switched by providing a plurality of rotation stoppers 72 and switching the rotation stopper 72 that is engaged with the rotation stopper 52. Since the orientation of the stacker 22 can be switched by providing the plurality of rotation stoppers 72 and switching the rotation stopper 72 that is engaged with the rotation stopper 52, the orientation of the stacker 22 can be appropriately set in accordance with the type and size of the sheet.

Furthermore, the sheet feeding cassette 11 includes the storage portion 21, in which sheets are stored, and the stacker 22, which includes the supporting surface 41 that supports the sheets. The stacker 22 is provided so that it can be displaced in a sliding manner with respect to the storage portion 21 and is provided so as to be pivotal at any position in the sliding area. Since the stacker 22 is capable of pivoting at any position in the sliding area of the stacker 22, the degree of freedom regarding combinations of the slide position and the orientation of the stacker 22 is increased. For example, even if the stacker 22 is in the way when the stacker 22 is slid from the contained position towards the extended position to store some sheets in the storage portion 21, the stacker 22 can be moved upwards and out of the way by pivoting the stacker 22; accordingly, the sheets can be stored with satisfactory work efficiency.

The printer 91 is provided with a recording head 104, which carries out recording on a sheet, and a sheet feeding cassette 11, which is attachable/detachable with respect to the recording head 104 that is provided with the body 101. The sheet, on which recording has been carried out, that is discharged from the body 101 can be supported by the stacker 22 that is in the extended state.

When in the mounted state, the sheet feeding cassette 11 protrudes from one of the lateral sides constituting the circumference of the body 101. The cover 102, which covers the upper portion of the sheet feeding cassette 11 that protrudes from one of the lateral sides and which serves as an intermediate guide member that guides the sheet that is discharged to the stacker 22 when the stacker 22 is in the extended state, can be provided in the body 101. Accordingly, the cover 102 allows the sheet to be discharged from the body 101 to the stacker 22 in a smooth manner.

The cover 102 is provided in a sheet transport path between a discharge roller (not shown) and the stacker 22 serving as the medium support tray. The cut-out 111 that exposes a portion of the stacker 22 that is in the contained state may be formed in the cover 102. Since the cut-out 111 that exposes a portion of the stacker 22 that is in the contained state is provided in the cover 102, when drawing out the stacker 22, it is easier to hold the stacker 22 and, accordingly, the stacker 22 is readily drawn out.

Note that the invention is not limited to the exemplary embodiments described above and may be modified in various ways that is within the scope of the claims. It goes without saying that the modifications are also included in the scope of the invention.

For example, while the sheet feeding cassette 11 is attachable/detachable with respect to the printer body in the present exemplary embodiment, the sheet feeding cassette 11 may be integrally provided with the printer body, in other words, the sheet feeding cassette 11 may be applied as a structure in which the storage portion 21 that stores the sheets is integrally provided with the printer body. In such a case, similar to the exemplary embodiment described above, the stacker 22 is provided in a sliding and pivoting manner.

Furthermore, while the stacker 22 of the exemplary embodiment described above is, when the stacker 22 is in the contained state, substantially parallel with the bottom surface of the storage portion 21 and, when the stacker 22 is in the extended state, inclines upwards, the stacker 22 may have a predetermined angle of inclination when the stacker 22 is in the contained state.

The entire disclosure of Japanese Patent Application No. 2013-091042, filed Apr. 24, 2013 is expressly incorporated by reference herein.

What is claimed is:

1. A medium storage cassette, comprising:

a medium storage portion that stores a medium;

a pair of opposite walls which are provided in the medium storage portion;

a plurality of angle restriction portions which are provided in the pair of opposite walls; and a medium support tray that is provided in the pair of opposite walls such that the medium support tray can be displaced with respect to the medium storage portion in a slidable manner, the medium support tray being able to be set in a contained state that is a state in which the medium support tray is slid to an upper portion of the medium storage portion and being able to be set in an extended state that is a state in which a medium supporting surface that supports the medium is extended outside of the medium storage portion, wherein the medium support tray includes:

a tray body that is capable of being pivoted and that forms the medium supporting surface, and arm portions that are provided at two end portions of the tray body in a pivotal axis direction of the medium support tray, the arm portions extending towards a pivotal center of the medium support tray from the tray body and being connected to the medium storage portion in a pivotal manner so as to form the pivotal center of the medium support tray, wherein the medium storage cassette includes guide portions which guide the arm portions when the medium support tray moves between the contained state and the extended state and which are provided on an upper portion of the medium storage portion, the medium storage portion being exposed between the arm portions, wherein the plurality of angle restriction portions are located separately from the guide portions, the plurality of angle restriction portions supporting a plurality of supported portions that project from the medium support tray when the medium support tray is slidable displaced, wherein switching from having a first supported portion that projects from the medium support tray be supported by a first angle restriction portion to having a second supported portion that projects from the medium support tray be supported by a second angle restriction portion changes the orientation of the medium support tray.

2. The medium storage cassette according to claim 1, wherein when the medium support tray is in the extended state, the medium supporting surface becomes an inclined surface that is oriented obliquely upwards towards an end portion of the medium support tray.

3. A recording device, comprising:

a recording head that carries out recording on a medium; and the medium storage cassette according to claim 2 that is attachable/detachable with respect to an apparatus body that is provided with the recording head, wherein the medium that is discharged from the apparatus body after recording has been carried out thereon is supported by the medium support tray that is in the extended state.

4. A recording device, comprising:

a recording head that carries out recording on a medium; and the medium storage cassette according to claim 1 that is attachable/detachable with respect to an apparatus body that is provided with the recording head, wherein the medium that is discharged from the apparatus body after recording has been carried out thereon is supported by the medium support tray that is in the extended state.

5. The recording device according to claim 4, wherein when in a mounted state, the medium storage cassette protrudes from one of lateral sides constituting a circumference of the apparatus body, and an intermediate guide member that covers an upper portion of the medium storage cassette that protrudes from one of the lateral sides of the apparatus body is provided, the intermediate guide member guiding a discharged medium to the medium support tray when the medium support tray is in the extended state.

6. The recording device according to claim 5, wherein an opening is formed in the intermediate guide member, the opening exposing a portion of the medium support tray that is in the contained state.

7. The recording device according claim 1, wherein the medium support tray that is provided in the medium storage portion such that the medium support tray can be displaced with respect to the medium storage portion in a slidable manner with sliding of the plurality of supported portions formed along a bottom surface of the medium support tray along the plurality of angle restriction portions that are formed in the medium storage portion.

8. The recording device according claim 1, wherein the medium support tray that is provided in the medium storage portion such that the medium support tray can be displaced with respect to the medium storage portion in a slidable manner with sliding of the plurality of supported portions formed along a bottom surface of the medium support tray along the plurality of angle restriction portions that are formed in the medium storage portion, the supported portions including a portion substantially horizontal to a base of the medium storage portion, a portion inclined relative to the base and a portion perpendicular to the base.

* * * * *